US009863607B2

(12) United States Patent
Jiang

(10) Patent No.: US 9,863,607 B2
(45) Date of Patent: Jan. 9, 2018

(54) OPTICAL SYSTEM FOR STAGE LAMP

(71) Applicant: GUANGZHOU HAOYANG ELECTRONIC CO., LTD, Guangdong (CN)

(72) Inventor: Weikai Jiang, Guangdong (CN)

(73) Assignee: GUANGZHOU HAOYANG ELECTRONIC CO., LTD., Guangdong (CN)

( * ) Notice: Subject to any disclaimer, the term of this patent is extended or adjusted under 35 U.S.C. 154(b) by 125 days.

(21) Appl. No.: 14/436,341

(22) PCT Filed: Feb. 22, 2013

(86) PCT No.: PCT/CN2013/071756
§ 371 (c)(1),
(2) Date: Apr. 16, 2015

(87) PCT Pub. No.: WO2014/059752
PCT Pub. Date: Apr. 24, 2014

(65) Prior Publication Data

US 2015/0276181 A1 Oct. 1, 2015

(30) Foreign Application Priority Data

Oct. 17, 2012 (CN) ..... 2012 1 0394319

(51) Int. Cl.
*F21V 14/04* (2006.01)
*F21V 13/06* (2006.01)
(Continued)

(52) U.S. Cl.
CPC ..... *F21V 13/06* (2013.01); *F21V 7/041* (2013.01); *F21V 13/04* (2013.01); *F21V 14/04* (2013.01); *F21W 2131/406* (2013.01)

(58) Field of Classification Search
CPC ..... B60Q 1/1438; F21S 48/1388; F21S 48/1784; F21W 2131/406; F21W 10/02;
(Continued)

(56) References Cited

U.S. PATENT DOCUMENTS 4,250,537 A * 2/1981 Roegner ..... A63J 17/00 362/133
4,519,020 A 5/1985 Little
(Continued)

FOREIGN PATENT DOCUMENTS

CN 2199410 Y 5/1995
CN 201193803 Y 2/2009
(Continued)

OTHER PUBLICATIONS

International Search Report for PCT/CN2013/071756 dated May 2, 2013.

*Primary Examiner* — Alan Cariaso
*Assistant Examiner* — Mark Tsidulko
(74) *Attorney, Agent, or Firm* — Pearne & Gordon LLP

(57) ABSTRACT

An optical system for a stage lamp wherein the optical system comprises: a light source, a light condensing device, an effect component, a lens, a multi-reflector optical component fixed on an upper portion of the lens, a light emitted by the light source being reflected by the light condensing device and converged to form a main light beam along a transmission direction of the light, the main light beam sequentially passing through the effect component and the lens and being reflected by the multi-reflector optical component; wherein the multi-reflector optical component is provided with at least three reflective mirrors, and is connected to a at least three-stage linkage mechanism which is capable of driving the multi-reflector optical component, and achieving a three-dimensional dynamic light spot effect. When the optical system according to the present invention
(Continued)

is applied to the stage lamp, one lamp simultaneously presenting a plurality of same dynamic spot effects is implemented.

10 Claims, 2 Drawing Sheets

(51) Int. Cl.
*F21V 7/04* (2006.01)
*F21V 13/04* (2006.01)
*F21W 131/406* (2006.01)

(58) Field of Classification Search
CPC ..... F21V 9/10; F21V 9/09; F21V 9/04; F21V 9/0025
USPC ..... 362/284, 293, 297, 346
See application file for complete search history.

(56) References Cited

U.S. PATENT DOCUMENTS 5,408,398 A * 4/1995 Chang ..... F21S 10/00 362/284
6,755,554 B2 * 6/2004 Ohmae ..... F21S 10/007 348/743
7,202,618 B2 * 4/2007 Ide ..... H02M 7/5387 318/400.12
7,297,929 B2 * 11/2007 Cernasov ..... G01J 1/04 250/214 AL
7,387,409 B1 * 6/2008 Beadle ..... F21S 8/081 362/153
7,442,929 B2 * 10/2008 Kitsuki ..... H01J 37/04 250/306
7,579,796 B2 * 8/2009 Hofer ..... H02P 6/185 318/259
7,731,368 B2 * 6/2010 Ghosh ..... G03B 21/16 353/60
8,110,393 B2 * 2/2012 Aparicio ..... G01N 33/491 356/36
8,398,271 B2 * 3/2013 Chan ..... F21V 14/04 362/232
8,403,530 B2 * 3/2013 Singer ..... F21V 7/0025 362/240
8,616,731 B2 * 12/2013 Quadri ..... F21V 9/08 362/282

FOREIGN PATENT DOCUMENTS

CN 201416832 Y 3/2010
CN 202327983 U 7/2012
CN 102901058 A 1/2013
KR 10-2010-0020649 A 7/2010

* cited by examiner

OPTICAL SYSTEM FOR STAGE LAMP

This application is a National Stage application of PCT international application PCT/CN2013/071756, filed on Feb. 22, 2013 which claims the priority of Chinese Patent Application No. 201210394319.8 entitled "OPTICAL SYSTEM FOR STORAGE LAMP", filed with the Chinese Patent Office on Oct. 17, 2012, both of which are incorporated herein by reference in their entirety.

TECHNICAL FIELD

The present invention relates to an optical system for a stage lamp, and pertains to improved technologies of the optical systems for the stage lamps.

BACKGROUND

Stage lamps play an important role in modern stage performance, which can achieve the following functions: (1) illumination for performance: to enable the audience to see the performance of actors and images of sceneries clearly; (2) guiding visions for the audience; (3) shaping people character images: to express feelings and show stage hallucinations; (4) creating a space environment for a play; (5) rendering atmosphere for a play; (6) displaying time and space conversion, highlighting play conflicts and strengthen stage rhythm, and enriching artistic appeal. The commonly used lamps are: spotlights, beam lights, soft lights, track lights, astigmatism lights, scanning lights, or the like.

The core technologies of the stage lamp are design of an optical system and design of a control manner, wherein the design of the optical system is essential to the lamp products. Good optical system can determine functions, effects, usages, and recognition in the market of the applied products. The optical system structure used for the current stage lamp is relatively single, such that it is hard for the stage lamp to achieve a dynamic light spot effect, and the usage effect of the stage lamp is poor.

SUMMARY

In view of the above problem, an objective of the present invention is to provide an optical system for a stage lamp capable of achieving a dynamic spot effect. The design of the present invention is reasonable, convenient and practical.

The present invention employs the following technical solution: An optical system for a stage lamp comprises: a light source, a light condensing device, an effect component, a lens, a multi-reflector optical component fixed on an upper portion of the lens, a light emitted by the light source being reflected by the light condensing device and converged to form a main light beam along a transmission direction of the light, the main light beam sequentially passing through the effect component and the lens and being reflected by the multi-reflector optical component; wherein the multi-reflector optical component is provided with at least three reflective mirrors, and is connected to a at least three-stage linkage mechanism which is capable of driving the multi-reflector optical component, and achieving a three-dimensional dynamic light spot effect.

The linkage mechanism comprises a first motor, a first motor fixing plate, a second motor fixing plate, a second motor, a third motor fixing plate, a third motor, and a reflective mirror fixing plate; wherein the multi-reflector optical component is fixed on the reflective mirror fixing plate, the first motor is fixed on the first motor fixing plate, the second motor is fixed on the second motor fixing plate, the third motor is fixed on the third motor fixing plate, a rotating shaft of the first motor is connected to the second motor fixing plate, a rotating shaft of the second motor is connected to the third motor fixing plate, and a rotating shaft of the third motor is connected to the reflective mirror fixing plate.

The first motor drives the multi-reflector optical component to rotate clockwise or counterclockwise around an axis A within a range of 0 to 360 degrees, the second motor drives the multi-reflector optical component to swing clockwise or counterclockwise around the axis A within a range of 0 to 90 degrees, and the third motor drives the multi-reflector optical component to continuously and all-around rotate around the rotating shaft of the third motor.

The second motor drives the multi-reflector optical component to swing clockwise or counterclockwise around the axis A within a range of 0 to 60 degrees.

The lens is a light condensing lens.

The multi-reflector optical component is integrally in a tapered shape.

An apex angle of the tapered shape is preferably within a range of 20 to 90 degrees. The apex angle of the tapered mirror body is decided by a lighting distance and a size of an illumination spatial range.

The effect component comprises at least a prism or a color wheel, wherein the color wheel is provided with at least a white round aperture.

The light condensing device is configured to collect light rays and change a paraboloid or ellipsoid of an aperture angle of the light beam, or a reflection cup of the ellipsoid of the light beam.

A light emitting point of the light source is disposed at a focal point F1 of the ellipsoid, and a majority of light rays emitted by the light source are converged at another focal point F2 of the ellipsoid after being reflected by the ellipsoid; and an aperture of the effect component is located at the focal point F2 of the ellipsoid or in the vicinity of the focal point F2.

Since the multi-reflector optical component connecting to the structure of a at least three-stage linkage mechanism, which is capable of driving the multi-reflector optical component and achieving a three-dimensional dynamic light spot effect, is used in the present invention, the light emitted by the light source is reflected by the light condensing device and converged to form a main light beam along a transmission direction of the light, wherein the main light beam sequentially passes through the effect component and the lens and is reflected by the multi-reflector optical component to form a plurality of dynamic light spot effects. The linkage mechanism is capable of driving the multi-reflector optical component, and achieving a plurality of light spot effects. When the optical system according to the present invention is applied to the stage lamp, one lamp simultaneously presenting a plurality of same dynamic spot effects is implemented. The present invention discloses a smartly designed, high-performance, convenient and practical optical system for the stage lamp.

DETAILED DESCRIPTION

Embodiment

Figure 1:
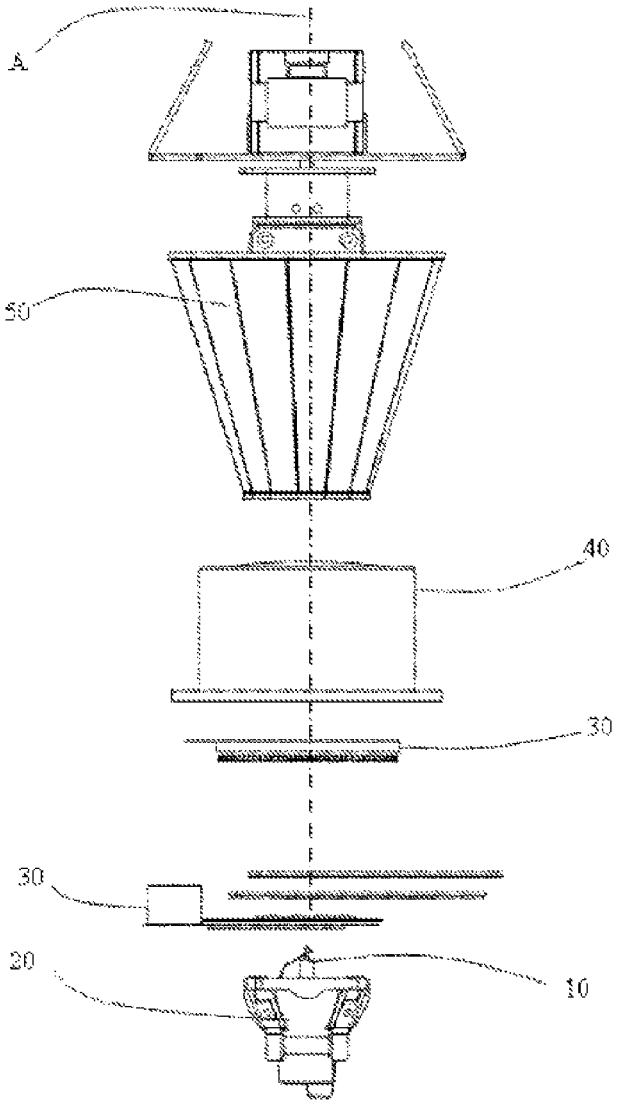
FIG. 1 is a schematic structural view according to the present invention.
Figure 2:
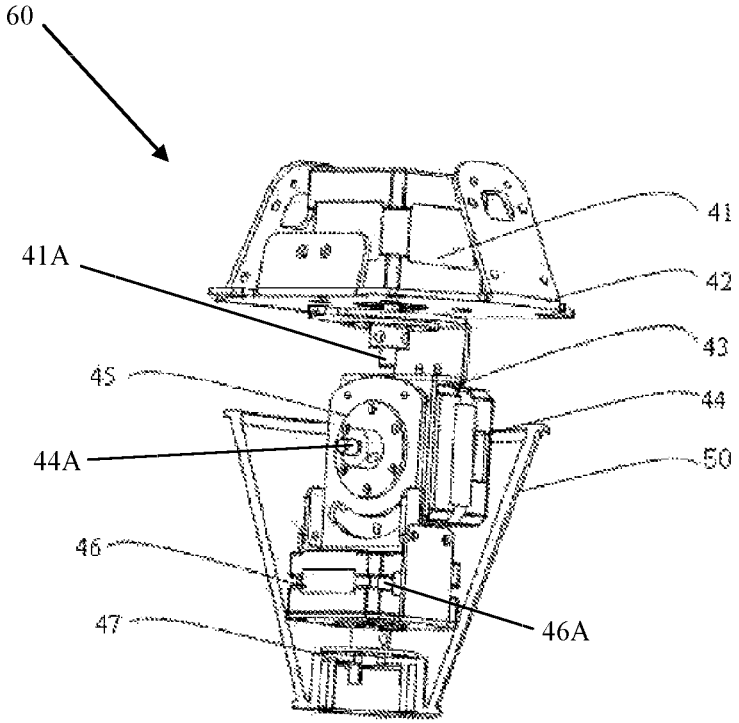
FIG. 2 is a schematic structural view of a linkage mechanism according to the present invention.
Figure 3:
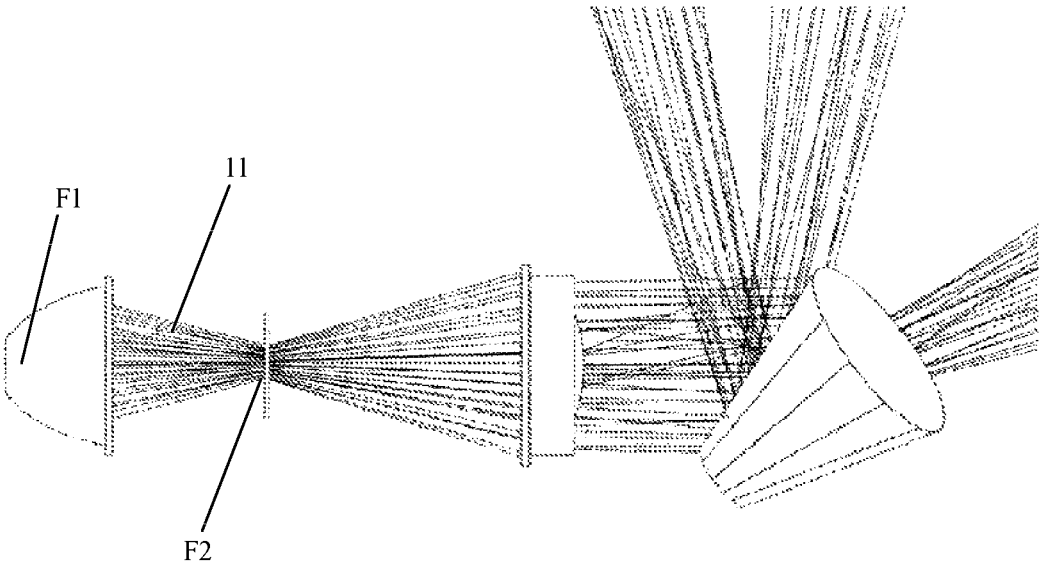
FIG. 3 is a schematic view of an optical path according to the present invention.

Schematic structural views of the present invention as illustrated in FIGS. 1 to 4. An optical system for a stage lamp according to the present invention, comprises: a light source 10, a light condensing device 20, an effect component 30, a lens 40, a multi-reflector optical component 50 fixed on an upper portion of the lens 40, a light emitted by the light source 10 being reflected by the light condensing device 20 and converged to form a main light beam 11 along a transmission direction of the light, the main light beam 11 sequentially passing through the effect component 30 and the lens 40 and being reflected by the multi-reflector optical component 50; wherein the multi-reflector optical component 50 is provided with at least three reflective mirrors, and is connected to an at least three-stage linkage mechanism 60 which is capable of driving the multi-reflector optical component 50, and achieving a three-dimensional dynamic light spot effect.

The above linkage mechanism comprises a first motor 41, a first motor fixing plate 42, a second motor fixing plate 43, a second motor 44, a third motor fixing plate 45, a third motor 46, and a reflective mirror fixing plate 47; wherein the multi-reflector optical component 50 is fixed on the reflective mirror fixing plate 47, the first motor 41 is fixed on the first motor fixing plate 42, the second motor 44 is fixed on the second motor fixing plate 43, the third motor 46 is fixed on the third motor fixing plate 45, a rotating shaft 41A of the first motor 41 is connected to the second motor fixing plate 43, a rotating shaft 44A of the second motor 44 is connected to the third motor fixing plate 45, and a rotating shaft 46A of the third motor 46 is connected to the reflective mirror fixing plate 47.

The first motor 41 drives the multi-reflector optical component 50 to reciprocally rotate clockwise or counterclockwise around an axis A within a range of 0 to 360 degrees, the second motor 44 drives the multi-reflector optical component 50 to reciprocally swing clockwise or counterclockwise around the axis A within a range of 0 to 90 degrees, and the third motor 46 drives the multi-reflector optical component 50 to continuously and all-around rotate around the rotating shaft of the third motor. In this embodiment, the third motor 46 drives the multi-reflector optical component 50 to continuously and all-around rotate around the rotating shaft of the third motor by over 360 degrees. For example, the third motor 46 drives the multi-reflector optical component 50 to rotate clockwise by 360 degrees, and then continued to rotate clockwise by 360 degrees, again and again. Or, the third motor 46 drives the multi-reflector optical component (50) to rotate counterclockwise by 360 degrees, and then continued to rotate counterclockwise by 360 degrees, again and again. In practical application, the clockwise rotation or counterclockwise rotation is decided according to actual needs.

In this embodiment, the first motor 41 drives the multi-reflector optical component 50 to reciprocally swing clockwise or counterclockwise around the axis A within a range of 0 to 360 degrees. Specifically, the first motor 41 drives the multi-reflector optical component 50 to reciprocally swing clockwise by 360 degrees, and then to reciprocally swing counterclockwise by 360 degrees.

Preferably, the second motor 44 drives the multi-reflector optical component 50 to reciprocally swing clockwise or counterclockwise around the axis A within a range of 0 to 60 degrees. In this embodiment, the second motor 44 drives the multi-reflector optical component 50 to reciprocally swing clockwise or counterclockwise around the axis A at 60 degrees. Specifically, the second motor 44 drives the multi-reflector optical component 50 to reciprocally swing clockwise by 60 degrees, and then to reciprocally swing counterclockwise by 60 degrees.

In this embodiment, the lens 40 is a light condensing lens. The multi-reflector optical component 50 is integrally in a tapered shape.

An apex angle of the tapered shape is within a range of 20 to 90 degrees. In this embodiment, the apex angle of the tapered shape is preferably 40 degrees.

The light source 10 is a bubble lamp or an LED lamp. In this embodiment, the light source 10 is a bubble lamp.

The effect component 30 comprises at least a prism or a color wheel, wherein the color wheel is provided with at least a white round aperture. In this embodiment, the effect component 30 comprises at least a color wheel, wherein the color wheel is provided with at least a white round aperture.

The light condensing device 20 is configured to collect light rays and change a paraboloid or ellipsoid of an aperture angle of the light beam, or a reflection cup of the ellipsoid of the light beam. In this embodiment, the light condensing device 20 is the reflection cup of the ellipsoid.

A light emitting point of the light source 10 is disposed at a focal point F1 of the ellipsoid, and a majority of light rays emitted by the light source 10 are converged at another focal point F2 of the ellipsoid after being reflected by the ellipsoid; and an aperture of the effect component 30 is located at the focal point F2 of the ellipsoid or in the vicinity of the focal point F2.

The working principle of the present invention is as follows: The light emitted by the light source 10 is reflected by the light condensing device 20 and converged to form a main light beam 11 along a transmission direction of the light, the main light beam 11 sequentially passes through the effect component 30 and the lens 40 and is reflected by the multi-reflector optical component 50 to form a plurality of light spots; and the linkage mechanism drives the multi-reflector optical component, and achieves a plurality of dynamic light spot effects.

The present invention is further described above with reference to the drawings and exemplary embodiments. However, a person skilled in the art should understand that described above are only exemplary illustrations and embodiments. The above embodiment is merely intended to illustrate the technical solution of the present invention but is not intended to limit the protection scope of the present invention, in particular, to limit the scope of claims. The scope of the present invention is defined by the appended claims.

What is claimed is:

1. An optical system for a stage lamp, comprising: a light source, a light condensing device, an effect component, a lens, a multi-reflector optical component fixed on an upper portion of the lens, a light emitted by the light source being reflected by the light condensing device and converged to form a main light beam along a transmission direction of the light, the main light beam sequentially passing through the effect component and the lens and being reflected by the multi-reflector optical component; wherein the multi-reflector optical component is provided with at least three reflective mirrors, and is connected to an at least three-stage linkage mechanism adapted for driving the multi-reflector optical component, and thereby achieving a three-dimensional dynamic light spot effect, wherein the linkage mechanism comprises a first motor, a first motor fixing plate, a second motor fixing plate, a second motor, a third motor fixing plate, a third motor, and a reflective mirror fixing plate;

wherein the multi-reflector optical component is fixed on the reflective mirror fixing plate, the first motor is fixed on the first motor fixing plate, the second motor is fixed on the second motor fixing plate, the third motor is fixed on the third motor fixing plate, a rotating shaft of the first motor is connected to the second motor fixing plate, a rotating shaft of the second motor is connected to the third motor fixing plate, and a rotating shaft of the third motor is connected to the reflective mirror fixing plate.

2. An optical system for a stage lamp according to claim 1, wherein the first motor drives the multi-reflector optical component to rotate clockwise or counterclockwise around an axis A within a range of 0 to 360 degrees, the second motor drives the multi-reflector optical component to swing clockwise or counterclockwise around the axis A within a range of 0 to 90 degrees, and the third motor drives the multi-reflector optical component to continuously and all-around rotate around the rotating shaft of the third motor.

3. An optical system for a stage lamp according to claim 2, wherein the second motor (44) drives the multi-reflector optical component (50) to swing clockwise or counterclockwise around the axis A within a range of 0 to 60 degrees.

4. An optical system for a stage lamp according to claim 1, wherein the lens (40) is a light condensing lens.

5. An optical system for a stage lamp according to claim 1, wherein the multi-reflector optical component (50) is integrally in a tapered shape.

6. An optical system for a stage lamp according to claim 5, wherein an apex angle of the tapered shape is within a range of 20 to 90 degrees.

7. An optical system for a stage lamp according to claim 1, wherein the effect component (30) comprises at least a prism or a color wheel, wherein the color wheel is provided with at least a round aperture.

8. An optical system for a stage lamp according to claim 1, wherein the light condensing device is configured to collect light rays and focus the light beam.

9. An optical system for a stage lamp according to claim 8, wherein a light emitting point of the light source is disposed at a focal point F1 of the light condensing device, and a majority of light rays emitted by the light source are converged at a second focal point F2 of the light condensing device after being reflected by the light condensing device; and an aperture of the effect component is located at the second focal point F2 or in the vicinity of the second focal point F2.

10. An optical system for a stage lamp according to claim 1, wherein the rotating shaft of the first motor is perpendicular to the rotating shaft of the second motor.

* * * * *